US011347177B2

(12) United States Patent
Tashiro et al.

(10) Patent No.: US 11,347,177 B2
(45) Date of Patent: May 31, 2022

(54) IMAGE FORMING APPARATUS WITH TWO-PART FRAME HAVING GRIPS

(71) Applicant: CANON KABUSHIKI KAISHA, Tokyo (JP)

(72) Inventors: Yuki Tashiro, Chiba (JP); Takuya Matsumura, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/230,836

(22) Filed: Apr. 14, 2021

(65) Prior Publication Data

US 2021/0356902 A1 Nov. 18, 2021

(30) Foreign Application Priority Data

May 15, 2020 (JP) ..... JP2020-086347

(51) Int. Cl.
*G03G 21/16* (2006.01)

(52) U.S. Cl.
CPC ..... *G03G 21/1619* (2013.01)

(58) Field of Classification Search
CPC ..... G03G 21/1619
See application file for complete search history.

(56) References Cited

U.S. PATENT DOCUMENTS

| | | | | |
|---|---|---|---|---|
| 9,535,365 | B2 | 1/2017 | Ishikawa et al. | F16H 1/08 |
| 10,025,270 | B2 | 7/2018 | Takahashi et al. | G03G 21/206 |
| 10,082,767 | B2 | 9/2018 | Matsumura | G03G 21/1619 |
| 10,162,306 | B2 | 12/2018 | Takahashi et al. | G03G 21/206 |
| 10,216,136 | B2 | 2/2019 | Suzuki et al. | G03G 15/70 |
| 10,372,078 | B2 | 8/2019 | Narita et al. | G03G 21/1647 |
| 2009/0123175 | A1* | 5/2009 | Takemoto | G03G 21/1619 399/107 |
| 2011/0129250 | A1* | 6/2011 | Kondo | G03G 21/1619 399/107 |
| 2017/0219992 | A1* | 8/2017 | Yasui | G03G 21/1619 |
| 2019/0049889 | A1 | 2/2019 | Ishikawa | G03G 15/556 |

FOREIGN PATENT DOCUMENTS

| | | |
|---|---|---|
| JP | 2005-134590 | 5/2005 |

OTHER PUBLICATIONS

U.S. Appl. No. 17/230,812, filed Apr. 14, 2021.
U.S. Appl. No. 17/231,739, filed Apr. 15, 2021.

* cited by examiner

*Primary Examiner* — Sandra Brase
(74) *Attorney, Agent, or Firm* — Venable LLP

(57) ABSTRACT

An image forming apparatus includes a sheet cassette, an image forming unit configured to form an image on a sheet fed from the sheet cassette, a first frame for supporting the sheet cassette, and a second frame provided on the first frame in a vertical direction for supporting the image forming unit. The first frame includes a first strut, a side plate spaced apart from the first strut, and a stay coupling the first strut and the side plate, wherein the sheet cassette is slidable in a direction in which the stay extends. The second frame includes a second strut coupled to the first strut. A grip is provided pivotably at the first strut, the grip being graspable by an operator.

19 Claims, 12 Drawing Sheets

IMAGE FORMING APPARATUS WITH TWO-PART FRAME HAVING GRIPS

BACKGROUND OF THE INVENTION

Field of the Invention

The present invention relates to an image forming apparatus, such as an electrophotographic copying machine or an electrophotographic printer (e.g., a laser-beam printer or an LED printer).

Description of the Related Art

Conventionally, known has been a configuration in which a first frame and a second frame disposed above the first frame in the vertical direction are coupled together as a frame of an image forming apparatus, similarly to a configuration in Japanese Patent Application Laid-Open No. 2005-134590. The first frame supports, for example, a sheet cassette which houses sheets. The second frame supports, for example, an image forming unit which forms an image on a sheet fed from the sheet cassette.

At the time of indoor installation of an image forming apparatus, the image forming apparatus requires lifting and conveying as work. In this respect, Japanese Patent Application Laid-Open No. 2005-134590 discloses a configuration in which the second frame is provided with grips that a worker grasps in order to lift the first frame and the second frame.

However, according to the configuration disclosed in Japanese Patent Application Laid-Open No. 2005-134590, in a case where the worker grasps any of the grips to lift the first frame and the second frame coupled together, the first frame results in being suspended by the second frame. In this case, the coupling portion between the first frame and the second frame is affected by the weight of most of the first frame, so that the coupling portion is likely to deform.

SUMMARY OF THE INVENTION

It is desirable to provide an image forming apparatus enabling inhibition of the coupling portion between a first frame and a second frame from deforming at the time of grasping of a grip and lifting of the first frame and the second frame coupled together.

According to a representative configuration of the present invention, provided is an image forming apparatus including:

- a sheet cassette configured to house a sheet;
- an image forming unit configured to form an image on the sheet fed from the sheet cassette;
- a first frame including: a first strut; a side plate spaced apart from the first strut; and a stay coupling the first strut and the side plate, the first frame supporting the sheet cassette, the sheet cassette being capable of slide-moving in a direction in which the stay extends;
- a second frame provided on the first frame in a vertical direction, the second frame including a second strut coupled to the first strut, the second frame supporting the image forming unit; and
- a grip provided pivotably at the first strut, the grip being graspable by an operator.

Further features of the present invention will become apparent from the following description of exemplary embodiments with reference to the attached drawings.

DESCRIPTION OF THE EMBODIMENTS

First Embodiment

<Image Forming Apparatus>

The entire configuration of an image forming apparatus according to a first embodiment of the present invention will be described below together with the operation at the time of image forming with reference to the drawings. Note that, unless otherwise specified, the scope of the invention is not limited to the dimensions, materials, and shapes of the following constituent components and the relative arrangements thereof.

The image forming apparatus A according to the present embodiment is of an intermediate tandem type which transfers four-color toners of yellow Y, magenta M, cyan C, and black K to an intermediate transfer belt and then transfers an image to a sheet to form the image. Note that, in the following description, members which involve the yellow toner are denoted with Y as the suffix, members which involve the magenta toner are denoted with M as the suffix, members which involve the cyan toner are denoted with C as the suffix, and members which involve the black toner are denoted with K as the suffix. However, the configurations and operations of the members are substantially the same except for the colors of toner. Thus, the suffixes thereof will be appropriately omitted when no distinction is required.

Figure 1:
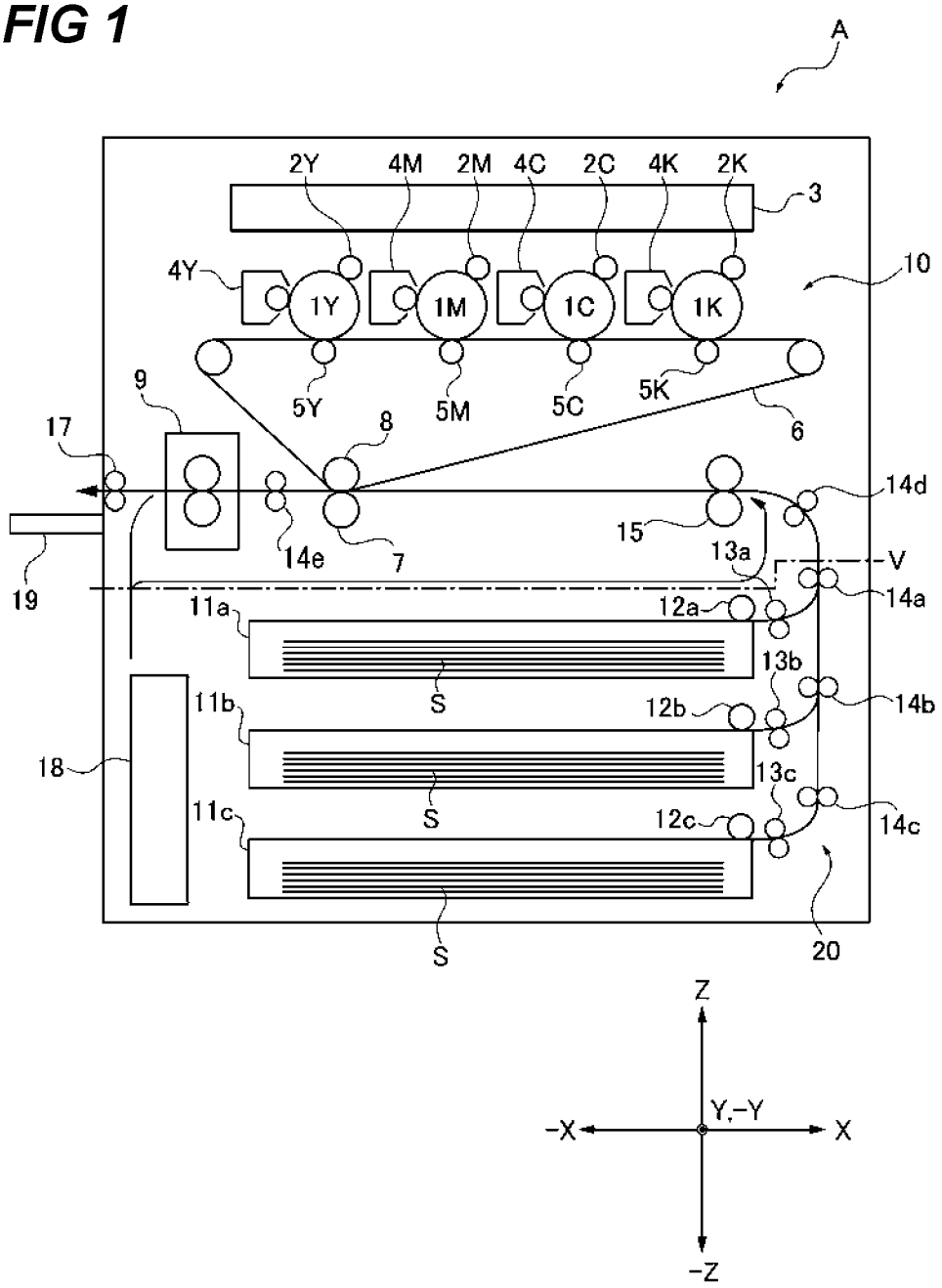
FIG. 1 is a schematic sectional view of an image forming apparatus.

FIG. 1 is a schematic sectional view of the image forming apparatus A. As illustrated in FIG. 1, the image forming apparatus A includes: an image forming unit 10 which forms an image on a sheet S; and a feed unit 20 which feeds the sheet S to the image forming unit 10.

The image forming unit 10 includes photoconductive drums 1 (1Y, 1M, 1C, and 1K), charging rollers 2 (2Y, 2M, 2C, and 2K), and developing devices 4 (4Y, 4M, 4C, and 4K). The image forming unit 10 includes primary transfer rollers 5 (5Y, 5M, 5C, and 5K), a laser scanner unit 3, an intermediate transfer belt 6, a secondary transfer roller 7, and a secondary transfer counter roller 8.

The feed unit 20 includes: sheet cassettes 11*a* to 11*c* which each house sheets S; and pickup rollers 12*a* to 12*c* which each pick up a sheet S housed in the corresponding sheet cassette 11*a*, 11*b*, or 11*c*. The feed unit 20 includes: feed rollers 13*a* to 13*c* which each feed the sheet S picked up by the corresponding pickup roller 12*a*, 12*b*, or 12*c* to a conveyance path; conveying rollers 14*a* to 14*d* which each convey the sheet S on the conveyance path; and a registration roller 15.

At the time of formation of an image by the image forming apparatus A, first, an image forming job signal is input to a controller not illustrated. This arrangement causes a sheet S housed in any of the sheet cassettes 11*a* to 11*c* to be picked up by the corresponding pickup roller 12*a*, 12*b*, or 12*c*. Next, the sheet S is sent to the registration roller 15 by the corresponding feed roller 13*a*, 13*b*, or 13*c* and conveying roller 14*a*, 14*b*, 14*c*, or 14*d*. After that, the sheet S is subjected to correction of skew by the registration roller 15. Then, at a predetermined timing, the sheet S is sent to a secondary transfer portion formed by the secondary transfer roller 7 and the secondary transfer counter roller 8.

Meanwhile, in the image forming unit 10, first, the surface of the photoconductive drum 1Y is charged by the charging roller 2Y. After that, according to image data transmitted from external equipment not illustrated, the laser scanner unit 3 irradiates the surface of the photoconductive drum 1Y with laser light, to form an electrostatic latent image on the surface of the photoconductive drum 1Y. After that, the developing device 4Y causes the yellow tonner to adhere to the electrostatic latent image formed on the surface of the photoconductive drum 1Y, so that a yellow toner image is formed on the surface of the photoconductive drum 1Y. In response to application of a primary transfer bias to the primary transfer roller 5Y, the tonner image formed on the surface of the photoconductive drum 1Y is primary-transferred to the intermediate transfer belt 6.

In similar processes, a magenta toner image, a cyan toner image, and a black toner image are formed on the photoconductive drums 1M, 1C, and 1K, respectively. Then, in response to application of a primary transfer bias to each of the primary transfer rollers 5M, 5C, and 5K, the corresponding toner image is transferred so as to be superimposed on the yellow toner image on the intermediate transfer belt 6. This arrangement results in formation of a full-color toner image, corresponding to the image signal, on the surface of the intermediate transfer belt 6. Note that, after the primary transfer, the toners adhering to the photoconductive drums 1Y, 1M, 1C, and 1K are each removed by a cleaning member not illustrated, resulting in being collected in a toner collection container 18.

After that, the full-color toner image is sent to the secondary transfer portion by a circumferential run of the intermediate transfer belt 6. Then, in response to application of a secondary transfer bias to the secondary transfer roller 7, the full-color toner image on the intermediate transfer belt 6 is transferred to the sheet S at the secondary transfer portion. The sheet S to which the toner image is transferred is conveyed to a fixing device 9 by a conveying roller 14*e*. Then, the sheet S is subjected to heating and pressing by the fixing device 9, so that the toner image on the sheet S is fixed to the sheet S. After that, the sheet S to which the toner image is fixed is discharged to a discharge tray 19 by a discharge roller 17.

<Frame for Image Forming Apparatus>

Next, the configuration of a frame 100 for the image forming apparatus A will be described.

Figure 2:
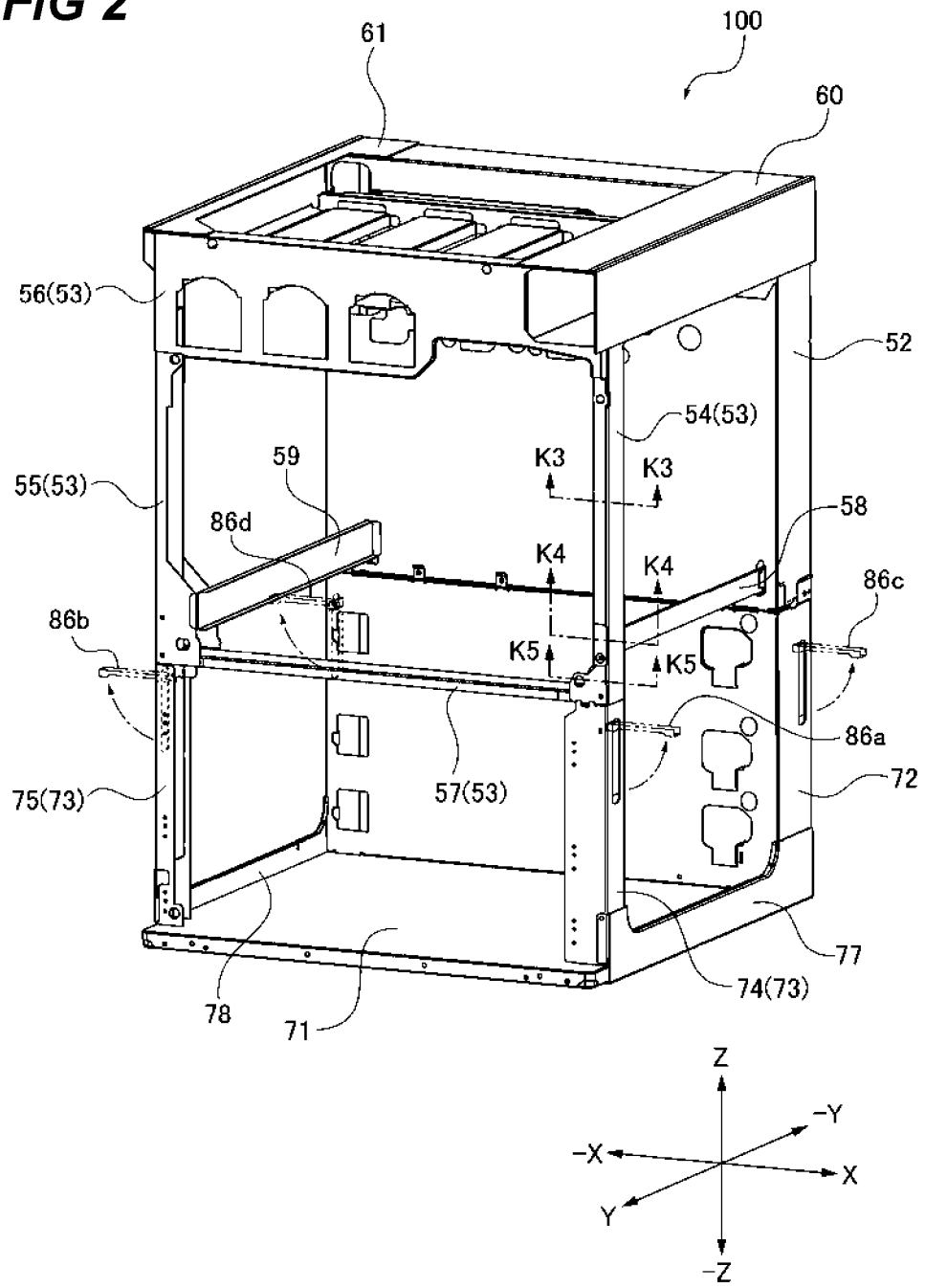
FIG. 2 is a perspective view of a frame of the image forming apparatus.
Figure 3:
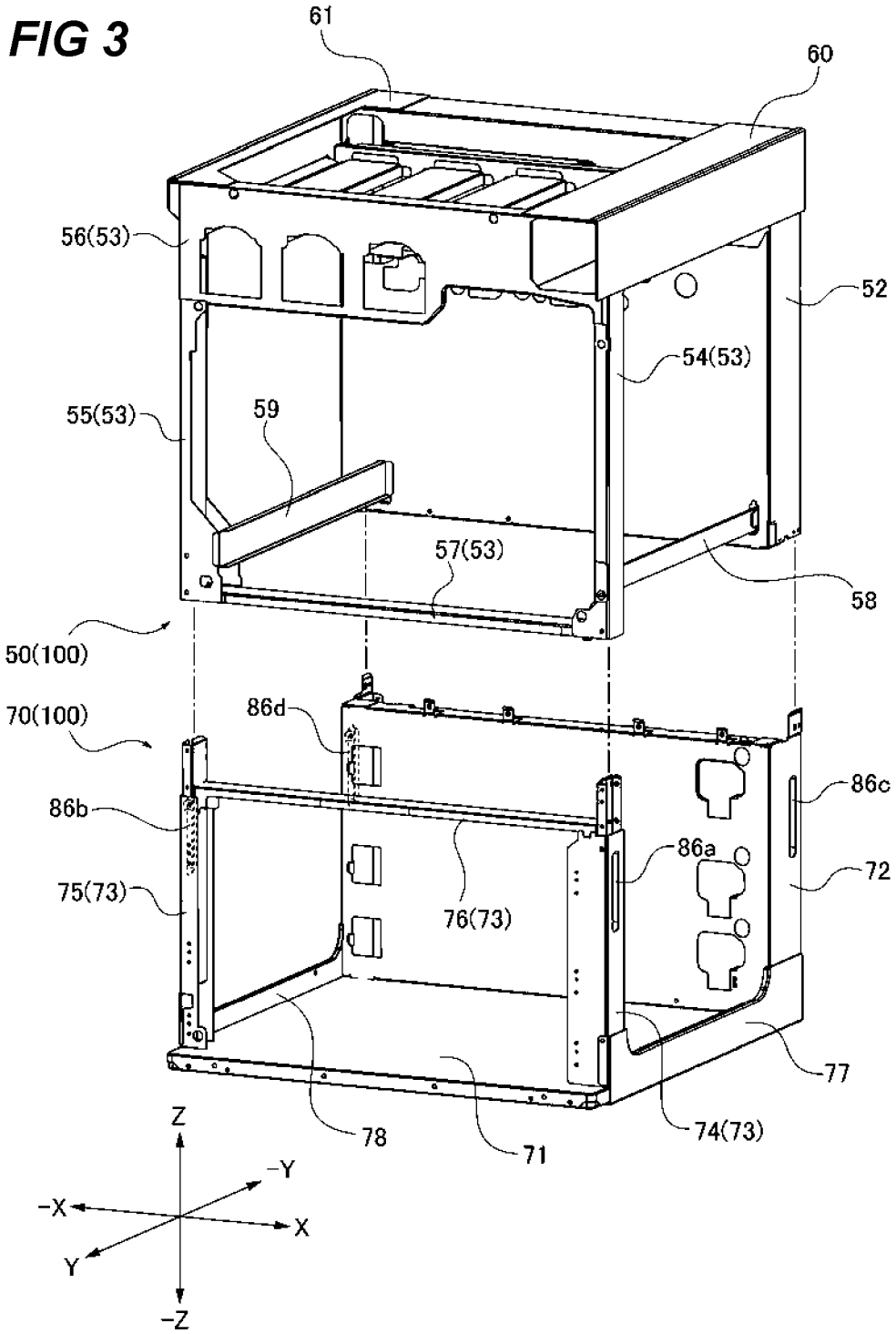
FIG. 3 is an exploded perspective view of the frame of the image forming apparatus.

FIG. 2 is a perspective view of the frame 100 for the image forming apparatus A. FIG. 3 is an exploded perspective view of the frame 100 for the image forming apparatus A. As illustrated in FIGS. 2 and 3, the frame 100 for the image forming apparatus A includes an upper frame 50 and a lower frame 70 coupled together. The upper frame 50 and the lower frame 70 are each made of sheet metal. The upper frame 50 is disposed at the upper portion in the vertical direction of the lower frame 70. Note that the lower frame 70 is to be, as the frame 100, incorporated normally with the image forming apparatus A and thus is different from a cassette pedestal unit which is optionally attached as an option for functional extension, such as an increase in the number of sheets S to be housed. A dot-and-dash line V illustrated in FIG. 1 indicates the boundary between the upper frame 50 and the lower frame 70.

The upper frame 50 (second frame) includes a front plate 53, a rear plate 52, and stays 58, 59, 60, and 61 which couple the front plate 53 and the rear plate 52 together. The front plate 53 includes an upper-right strut 54 (second strut), an upper-left strut 55, and stays 56 and 57 which couple the upper-right strut 54 and the upper-left strut 55 together. The stays 56 and 57 are welded to the upper-right strut 54 and the upper-left strut 55. The stay 58 is welded to the upper-right strut 54 and the rear plate 52. The stay 59 is welded to the upper-left strut 55 and the rear plate 52. The stays 60 and 61 are welded to the stay 56 and the rear plate 52.

The lower frame 70 (first frame) includes a front plate 73, a rear plate 72, stays 77 and 78 which couple the front plate 73 and the rear plate 72 together, and a bottom plate 71. The front plate 73 includes a lower-right strut 74 (first strut), a lower-left strut 75 (third strut), and a stay 76 which couples the lower-right strut 74 and the lower-left strut 75 together. The stay 76 is welded to the lower-right strut 74 and the lower-left strut 75. The stay 77 is welded to the lower-right strut 74 and the rear plate 72. The stay 78 is welded to the lower-left strut 75 and the rear plate 72.

The bottom plate 71 of the lower frame 70 is provided with casters, not illustrated, enabling movement of the image forming apparatus A to an installation face for the image forming apparatus A. The rear plate 72, the lower-right strut 74, and the lower-left strut 75 are secured to a face of the bottom plate 71, the face being opposite to the other face of the bottom plate 71 to which the casters, not illustrated, are attached. In the lower frame 70, the lower-right strut 74, the lower-left strut 75, and both end portions in the directions of arrows X and −X of the rear plate 72 are provided, respectively, with grips 86*a* to 86*d* graspable, at the time of lifting of the image forming apparatus A, by an operator who operates the image forming apparatus A or a worker who conveys the image forming apparatus A. The grips 86*a* to 86*d* are used, for example, when the worker who is conveying the image forming apparatus A with the casters, not illustrated, lifts the image forming apparatus A to get over a step. The configuration of the grips 86*a* to 86*d* will be described in detail later.

Figure 4:
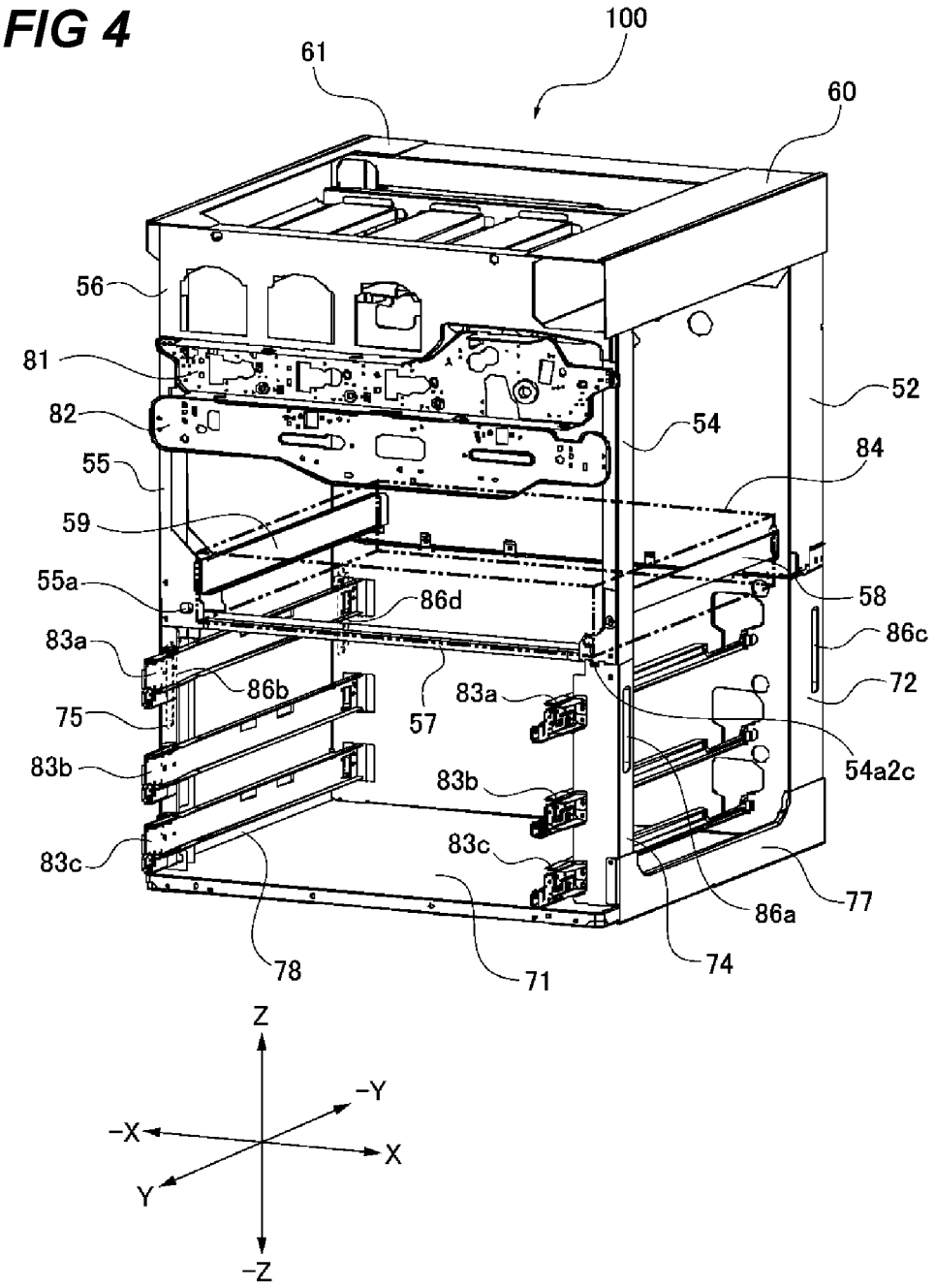
FIG. 4 is a perspective view of the frame of the image forming apparatus.

FIG. 4 illustrates the frame 100 for the image forming apparatus A, to which members which support the photoconductive drums 1 and the sheet cassettes 11 are attached. As illustrated in FIG. 4, a support member 81 which supports the photoconductive drums 1 and the developing devices 4, is positioned and attached to the upper-right strut 54 and the upper-left strut 55 of the upper frame 50. The support member 81 supports, rotatably, one end portion in the direction of the rotational axis of each of the photoconductive drums 1 and developing sleeves, not illustrated, included in the developing devices 4. The other end portion in the direction of the rotational axis of each of the photoconductive drums 1 and the developing sleeves is supported rotatably by the rear plate 52.

A belt support member 82 which supports the intermediate transfer belt 6 is positioned and attached to the upper-right strut 54 and the upper-left strut 55 of the upper frame 50. The belt support member 82 supports, rotatably, one end portion in the direction of the rotational axis of each of the secondary transfer counter roller 8 and the other rollers around which the intermediate transfer belt 6 is stretched. The other end portion in the direction of the rotational axis of the secondary transfer counter roller 8 is supported rotatably by the rear plate 52.

A front plate as the frame on the front side of a fixing and conveying unit 84 including the fixing device 9 and the conveying roller 14*e* united together, is attached to the upper-right strut 54 and the upper-left strut 55 of the upper frame 50. The position of the fixing and conveying unit 84 to the upper-right strut 54 and the upper-left strut 55 is determined by one-to-one fitting of pins, not illustrated, on the front plate of the fixing and conveying unit 84 to a fitting hole 54*a*2*c* formed on the upper-right strut 54 and a fitting hole 55*a* formed on the upper-left strut 55.

The conveying roller 14*d* (second conveying roller) is supported by the frame of the fixing and conveying unit 84. That is, determination of the position of the fixing and conveying unit 84 to the upper-right strut 54 and the upper-left strut 55 causes determination of the position of the conveying roller 14*d*. One end portion in the direction of the rotational axis of the conveying roller 14*a* (first conveying roller) which feeds a sheet S to the conveying roller 14*d*, is positioned to and then is supported rotatably by the lower-right strut 74. The other end portion in the direction of the rotational axis of the conveying roller 14*a* is supported rotatably by the rear plate 52.

A support rail 83*a* which supports the sheet cassette 11*a*, a support rail 83*b* which supports the sheet cassette 11*b*, and a support rail 83*c* which supports the sheet cassette 11*c* are positioned and attached to each of the lower-right strut 74 and the lower-left strut 75 of the lower frame 70. The support rails 83*a*, 83*b*, and 83*c* serve as stays (first guide portion and second guide portion) which couple the lower-right strut 74, the lower-left strut 75, and the rear plate 72 together. At the position between the lower-right strut 74 and the lower-left strut 75, the sheet cassettes 11*a* to 11*c* slide-move while being guided by the support rails 83*a* to 83*c* so as to be inserted in the direction of arrow −Y or so as to be drawn in the direction of arrow Y.

In the present embodiment, the front face of the image forming apparatus A is oriented in the direction of arrow Y in which the sheet cassettes 11*a* to 11*c* are drawable, and the rear face of the image forming apparatus A is oriented in the direction of arrow −Y in which the sheet cassettes 11*a* to 11*c* are insertable. The right face of the image forming apparatus A is oriented in the direction of arrow X orthogonal to the directions of arrows Y and −Y and the directions of arrows Z and −Z along the vertical direction. The left face of the image forming apparatus A is oriented in the direction of arrow −X inverse to the direction of arrow X. That is, in the direction of movement of the sheet cassettes 11*a* to 11*c*, the lower-right strut 74 and the lower-left strut 75 are disposed opposed to the rear plate 72 in the lower frame 70. The lower-right strut 74 and the lower-left strut 75 are disposed opposed to each other in the direction orthogonal to the direction of movement of the sheet cassettes 11*a* to 11*c* and the vertical direction.

<Struts>

Next, the configuration of the struts of the frame 100 for the image forming apparatus A will be described in detail. Note that the upper-right strut 54 and the lower-right strut 74 will be described below and are similar in configuration to the upper-left strut 55 and the lower-left strut 75, respectively.

Figure 5A:
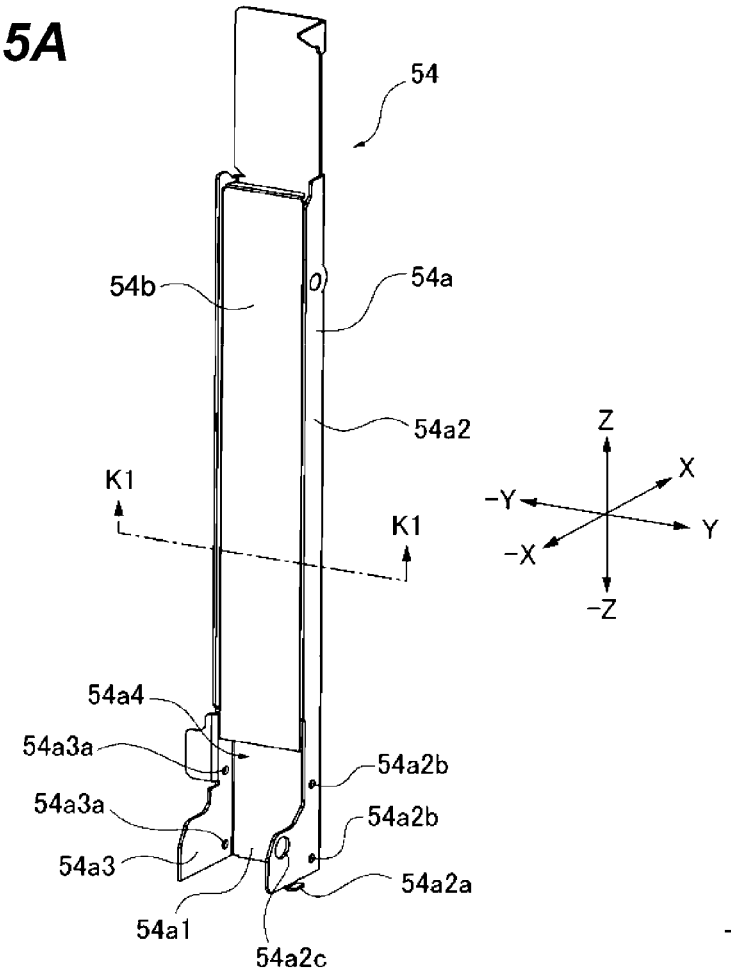
FIG. 5A is a perspective view of an upper-right strut.
Figure 5B:
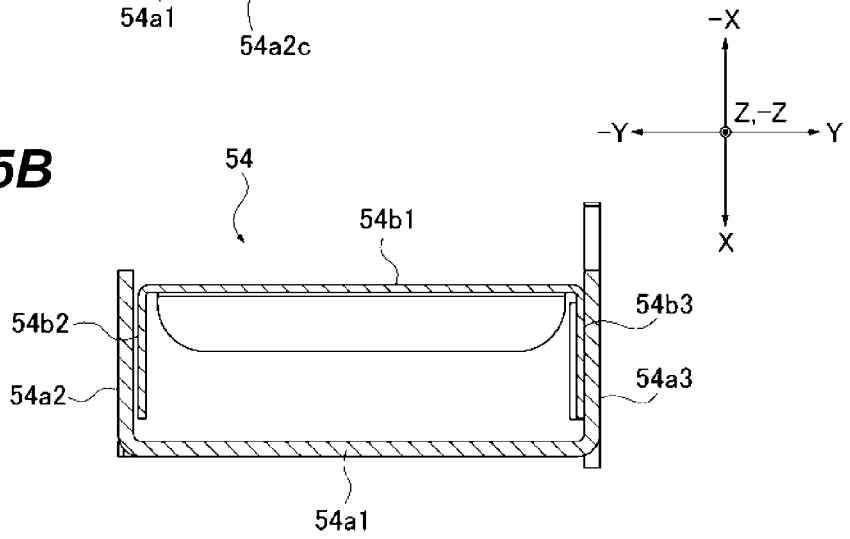
FIG. 5B is a sectional view of the upper-right strut.

FIG. 5A is a perspective view of the upper-right strut 54. FIG. 5B is a sectional view of the upper-right strut 54 taken along line K1-K1 of FIG. 5A. As illustrated in FIGS. 5A and 5B, the upper-right strut 54 includes an outer member 54*a* and an inner member 54*b* which are coupled through a screw not illustrated. Note that provided may be a configuration in which the outer member 54*a* and the inner member 54*b* are coupled by welding, a configuration in which the outer member 54*a* and the inner member 54*b* are integrally molded by casting or stamping, or a configuration in which the outer member 54*a* and the inner member 54*b* are integrally formed by cutting.

The outer member 54*a* includes: a base portion 54*a*1; a bent portion 54*a*2 which is a substantially perpendicularly bent one end portion of the base portion 54*a*1; and a bent portion 54*a*3 (another bent portion) which is the substantially perpendicularly bent other end portion of the base portion 54*a*1 and is opposed to the bent portion 54*a*2. Thus, the outer member 54*a* has a U shape as a whole. Note that, in the present embodiment, the U shape of the outer member 54*a* results from one piece of sheet metal subjected to bending. However, a substantially U shape may be formed by combining two pieces of sheet metal, each having an L shape. The meaning "substantially perpendicular" herein includes not only an angle of 90 degrees of the bent portions 54*a*2 and 54*a*3 to the base portion 54*a*1 but also, for example, angles of 89 to 91 degrees in consideration of dimensional tolerance and manufacturing errors. The bent portions 54*a*2 and 54*a*3 may each have a step as long as the bent portions 54*a*2 and 54*a*3 are opposed to each other, substantially perpendicularly to the base portion 54*a*1. The bent portions 54*a*2 and 54*a*3 may each have a shape like an arc to the base portion 54*a*1.

The inner member 54*b* includes: a base portion 54*b*1; a bent portion 54*b*2 which is a substantially perpendicularly bent one end portion of the base portion 54*b*1; and a bent portion 54*b*3 (another bent portion) which is the substantially perpendicularly bent other end portion of the base portion 54*b*1 and is opposed to the bent portion 54*b*2. The inner member 54*b* has a U shape as a whole. Note that, in the present embodiment, the U shape of the inner member 54*b* results from one piece of sheet metal subjected to bending. However, a substantially U shape may be formed by combining two pieces of sheet metal, each having an L shape. The meaning "substantially perpendicular" herein includes not only an angle of 90 degrees of the bent portions 54*b*2 and 54*b*3 to the base portion 54*b*1 but also, for example, angles of 89 to 91 degrees in consideration of dimensional tolerance and manufacturing errors. The bent portions 54*b*2 and 54*b*3 may each have a step as long as the bent portions 54*b*2 and 54*b*3 are opposed to each other, substantially perpendicularly to the base portion 54*b*1. The bent portions 54*b*2 and 54*b*3 may each have a shape like an arc to the base portion 54*b*1.

The outer member 54*a* and the inner member 54*b* are disposed such that their U-shaped opening portions face each other. That is the base portion 54*b*1 of the inner member 54*b* is spaced apart from and opposed to the base portion 54*a*1 of the outer member 54*a*. The bent portion 54*b*2 of the inner member 54*b* is coupled to the bent portion 54*a*2 of the outer member 54*a* through a screw not illustrated. The bent portion 54*b*3 of the inner member 54*b* is coupled to the bent portion 54*a*3 of the outer member 54*a* through a screw not illustrated. This arrangement secures the rigidity of the upper-right strut 54 having a rectangular sectional shape. That is, the inner member 54*b* is part of the upper-right strut 54 and serves as a reinforcing member which reinforces the outer member 54*a*.

The bent portion 54*a*2 of the outer member 54*a* has screw holes 54*a*2*b*, and the bent portion 54*a*3 of the outer member 54*a* has screw holes 54*a*3*a*. The lower end portion of the bent portion 54*a*2 of the outer member 54*a* is provided with a protrusion 54*a*2*a* (engaging portion) protruding in the direction of arrow Y. With the lower end portion of the outer member 54*a* located below the lower end portion of the inner member 54*b*, provided is a reception portion 54*a*4 which has a space due to a portion of the outer member 54*a* protruding below the inner member 54*b* and receives the lower-right strut 74.

Figure 6A:
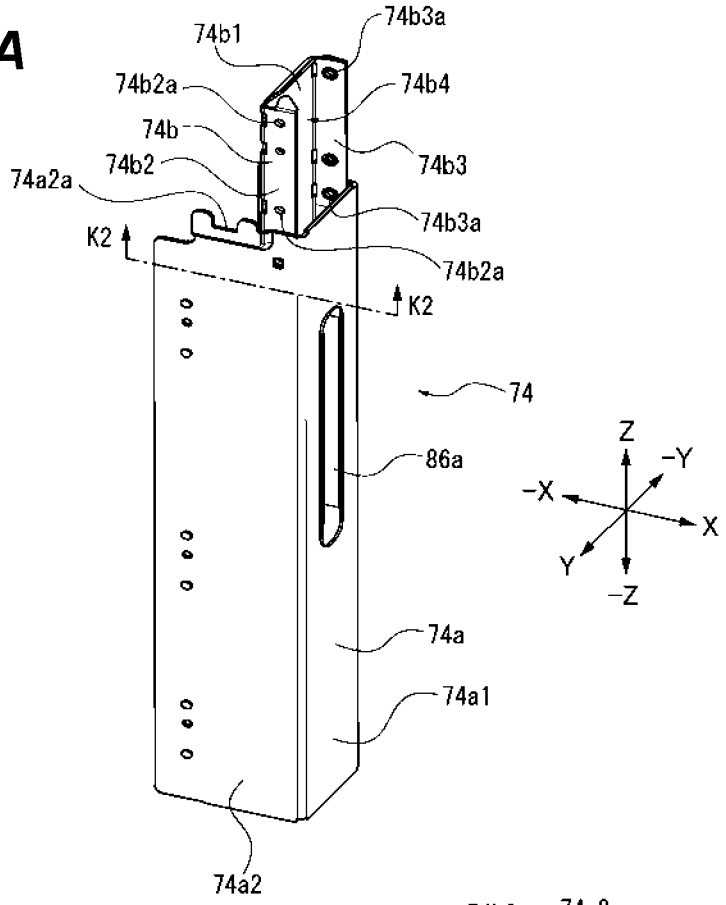
FIG. 6A is a perspective view of a lower-right strut.
Figure 6B:
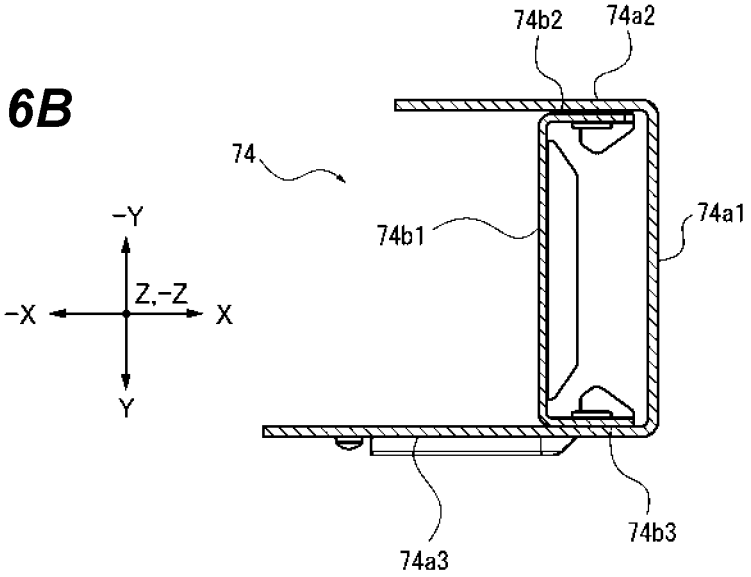
FIG. 6B is a sectional view of the lower-right strut.

FIG. 6A is a perspective view of the lower-right strut 74. FIG. 6B is a sectional view of the lower-right strut 74 taken along line K2-K2 of FIG. 6A. As illustrated in FIGS. 6A and 6B, the lower-right strut 74 includes an outer member 74*a* and an inner member 74*b* which are coupled through a screw not illustrated. Note that provided may be a configuration in which the outer member 74*a* and the inner member 74*b* are coupled by welding, a configuration in which the outer member 74*a* and the inner member 74*b* are integrally molded by casting or stamping, or a configuration in which the outer member 74*a* and the inner member 74*b* are integrally formed by cutting.

The outer member 74*a* includes: a base portion 74*a*1; a bent portion 74*a*2 which is a substantially perpendicularly bent one end portion of the base portion 74*a*1; and a bent portion 74*a*3 (another bent portion) which is the substantially perpendicularly bent other end portion of the base portion 74*a*1 and is opposed to the bent portion 74*a*2. The outer member 74*a* has a U shape as a whole. Note that, in the present embodiment, the U shape of the outer member 74*a* results from one piece of sheet metal subjected to bending. However, a substantially U shape may be formed by combining two pieces of sheet metal, each having an L shape. The meaning "substantially perpendicular" herein includes not only an angle of 90 degrees of the bent portions 74*a*2 and 74*a*3 to the base portion 74*a*1 but also, for example, angles of 89 to 91 degrees in consideration of dimensional tolerance and manufacturing errors. The bent portions 74*a*2 and 74*a*3 may each have a step as long as the bent portions 74*a*2 and 74*a*3 are opposed to each other, substantially perpendicularly to the base portion 74*a*1. The bent portions 74*a*2 and 74*a*3 may each have a shape like an arc to the base portion 74*a*1.

The inner member 74*b* includes: a base portion 74*b*1; a bent portion 74*b*2 which is a substantially perpendicularly bent one end portion of the base portion 74*b*1; and a bent portion 74*b*3 (another bent portion) which is the substantially perpendicularly bent other portion of the base portion 74*b*1 and is opposed to the bent portion 74*b*2. The inner member 74*b* has a U shape as a whole. Note that, in the present embodiment, the U shape of the inner member 74*b* results from one piece of sheet metal subjected to bending. However, a substantially U shape may be formed by combining two pieces of sheet metal, each having an L shape. The meaning "substantially perpendicular" herein includes not only an angle of 90 degrees of the bent portions 74*b*2 and 74*b*3 to the base portion 74*b*1 but also, for example, angles of 89 to 91 degrees in consideration of dimensional tolerance and manufacturing errors. The bent portions 74*b*2 and 74*b*3 may each have a step as long as the bent portions 74*b*2 and 74*b*3 are opposed to each other, substantially perpendicularly to the base portion 74*b*1. The bent portions 74*b*2 and 74*b*3 may each have a shape like an arc to the base portion 74*b*1.

The outer member 74*a* and the inner member 74*b* are disposed such that their U-shaped opening portions face each other. That is the base portion 74*b*1 of the inner member 74*b* is spaced apart from and opposed to the base portion 74*a*1 of the outer member 74*a*. The bent portion 74*b*2 of the inner member 74*b* is coupled to the bent portion 74*a*2 of the outer member 74*a* through a screw not illustrated. The bent portion 74*b*3 of the inner member 74*b* is coupled to the bent portion 74*a*3 of the outer member 74*a* through a screw not illustrated. This arrangement secures the rigidity of the lower-right strut 74 having a rectangular sectional shape. That is, the inner member 74*b* is part of the lower-right strut 74 and serves as a reinforcing member which reinforces the lower-right strut 74.

The bent portion 74*b*2 of the inner member 74*b* has screw holes 74*b*2*a*, and the bent portion 74*b*3 of the inner member 74*b* has screw holes 74*b*3*a*. The upper end portion of the bent portion 74*a*2 of the outer member 74*a* is provided with a recessed portion 74*a*2*a* (engaged portion) which is recessed downward in the vertical direction. With the upper end portion of the inner member 74*b* located above the upper end portion of the outer member 74*a*, a portion of the inner member 74*b* protruding above the outer member 74*a* serves as a protruding portion 74*b*4 which is received by the reception portion 54*a*4 of the upper-right strut 54.

Figure 7A:
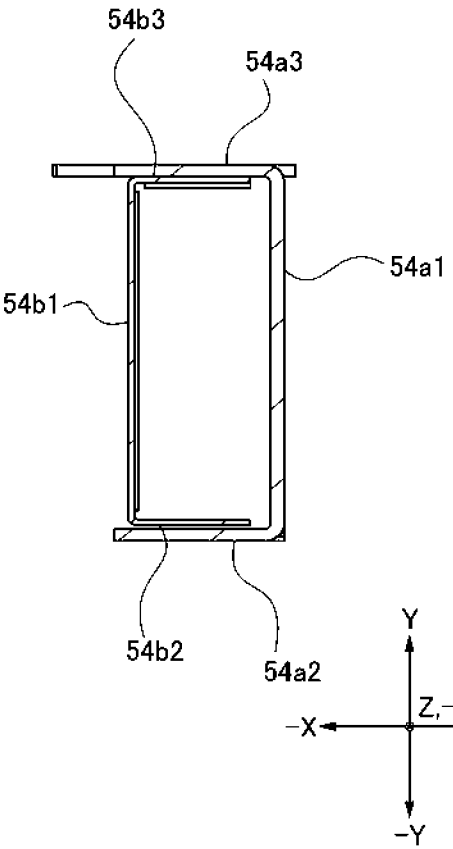
FIG. 7A is a sectional view taken along line K3-K3 of the frame of the image forming apparatus.
Figure 7B:
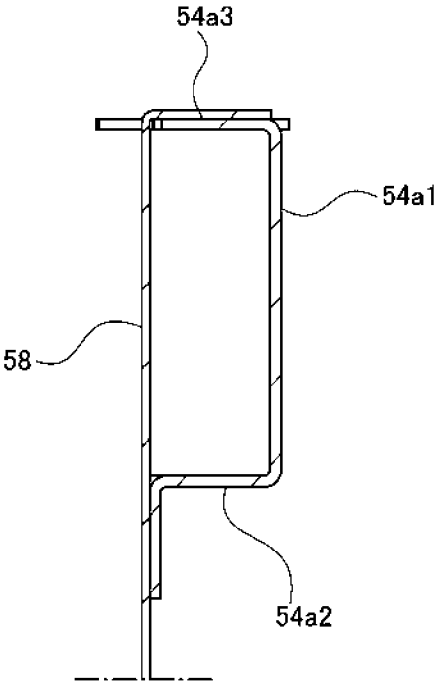
FIG. 7B is a sectional view taken along line K4-K4 of the frame of the image forming apparatus.
Figure 7C:
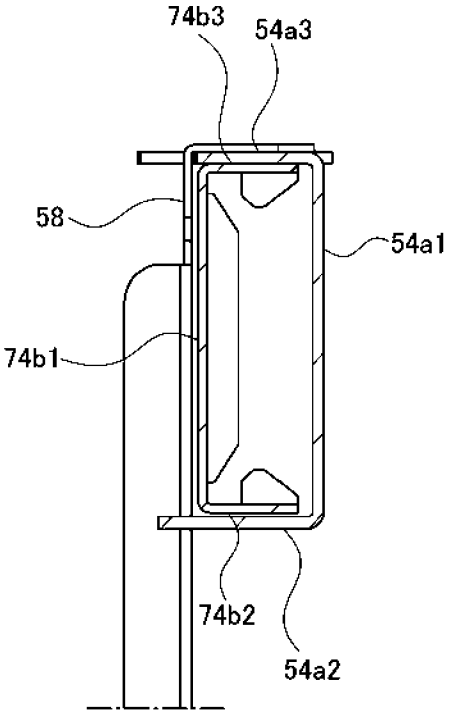
FIG. 7C is a sectional view taken along line K5-K5 of the frame of the image forming apparatus.

FIG. 7A is a sectional view of the frame 100 for the image forming apparatus A, taken along line K3-K3 of FIG. 2. FIG. 7B is a sectional view of the frame 100 for the image forming apparatus A, taken along line K4-K4 of FIG. 2. FIG. 7C is a sectional view of the frame 100 for the image forming apparatus A, taken along line K5-K5 of FIG. 2.

As illustrated in FIG. 7A, at the position of line K3-K3 of FIG. 2, a rectangular section is formed due to the outer member 54*a* and the inner member 54*b* of the upper-right strut 54. Specifically, the base portion 54*a*1, the bent portion 54*a*2, and the bent portion 54*a*3 of the outer member 54*a*, and the base portion 54*b*1 of the inner member 54*b* serve as the sides of the rectangular section. Note that the bent portion 54*a*2 of the outer member 54*a* and the bent portion 54*b*2 of the inner member 54*b* are disposed overlapping each other, and the bent portion 54*a*3 of the outer member 54*a* and the bent portion 54*b*3 of the inner member 54*b* are disposed overlapping each other.

As illustrated in FIG. 7B, at the position of line K4-K4 of FIG. 2, a rectangular section is formed due to the outer member 54*a* of the upper-right strut 54 and the stay 58. Specifically, the base portion 54*a*1, the bent portion 54*a*2, and the bent portion 54*a*3 of the outer member 54*a*, and the stay 58 serve as the sides of the rectangular section. That is, the stay 58 is coupled to the upper-right strut 54 such that a rectangular section is formed by the stay 58 together with the base portion 54*a*1, the bent portion 54*a*2, and the bent portion 54*a*3 of the outer member 54*a* between the inner member 54*b* of the upper-right strut 54 and the inner member 74*b* of the lower-right strut 74 in the vertical direction.

As illustrated in FIG. 7C, at the position of line K5-K5 of FIG. 2, a rectangular section is formed due to the outer member 54*a* of the upper-right strut 54 and the inner member 74*b* of the lower-right strut 74. Specifically, the base portion 54*a*1, the bent portion 54*a*2, and the bent portion 54*a*3 of the outer member 54*a* in the upper-right strut 54, and the base portion 74*b*1 of the inner member 74*b* in the lower-right strut 74 serve as the sides of the rectangular section. Note that the bent portion 54*a*2 of the outer member 54*a* in the upper-right strut 54 and the bent portion 74*b*2 of the inner member 74*b* in the lower-right strut 74 are disposed overlapping each other, and the bent portion 54*a*3 of the outer member 54*a* in the upper-right strut 54 and the bent portion 74*b*3 of the inner member 74*b* in the lower-right strut 74 are disposed overlapping each other.

As above, most of the upper-right strut 54 and the lower-right strut 74, which are the struts on the right side of the frame 100 for the image forming apparatus A, are rectangular in section regardless of position, resulting in enhancement in rigidity. Similarly, most of the upper-left strut 55 and the lower-left strut 75, which are the struts on the left side of the frame 100 for the image forming apparatus A, are rectangular in section regardless of position, resulting in enhancement in rigidity. Note that, in the present embodiment, the sectional shape of each strut is rectangular. However, any quadrilateral, such as a square, enables enhancement in rigidity, and thus the sectional shape may be square.

<Configuration of Coupling of Struts>

As described above, the image forming unit 10, the sheet cassettes 11*a* to 11*c*, and the conveying rollers 14*a* and 14*d* are directly or indirectly positioned by the upper-right strut 54, the lower-right strut 74, the upper-left strut 55, and the lower-left strut 75. Thus, at the time of coupling of the upper frame 50 and the lower frame 70, a low relative positional accuracy between the upper-right strut 54 and the lower-right strut 74 or a low relative positional accuracy between the upper-left strut 55 and the lower-left strut 75 causes deterioration in the relative positional accuracy between the conveying roller 14*a* and the conveying roller 14*d*. In this case, at the time of feed of a sheet S from the conveying roller 14*a* to the conveying roller 14*d*, the sheet S skews, causing a deviation in the image position to the sheet S, so that the image forming quality is likely to deteriorate. Note that the registration roller 15 performs correction of skew to the sheet S, but some levels of skew of the sheet S are likely to disable correction of skew. Thus, in the present embodiment, the following configuration inhibits the relative positional accuracy between each strut from deteriorating.

Figures 8A, 8B, 8C:
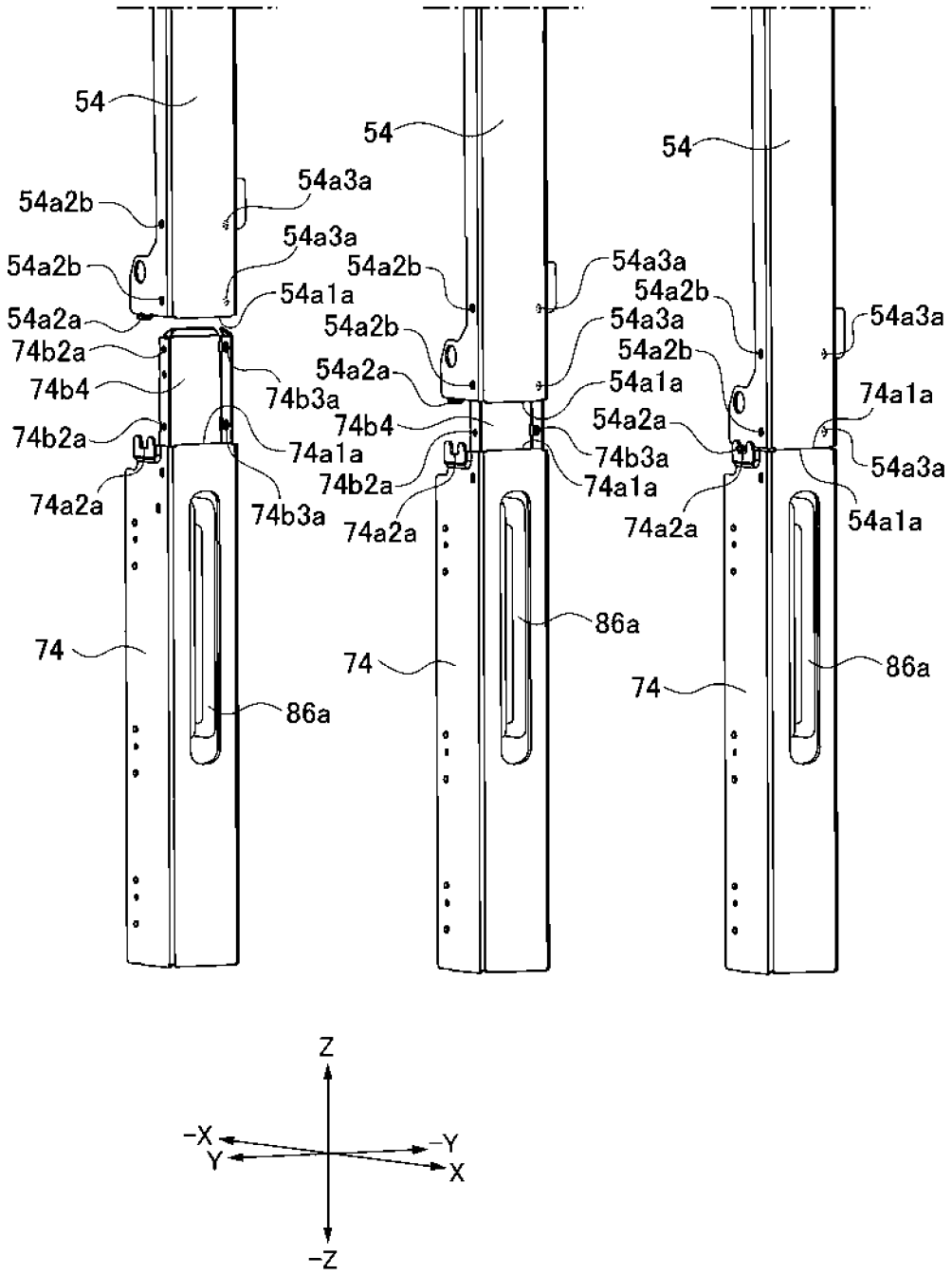
FIG. 8A is a perspective view of the upper-right strut and the lower-right strut before coupling.
FIG. 8B is a perspective view of the upper-right strut and the lower-right strut, which are being coupled together.
FIG. 8C is a perspective view of the upper-right strut and the lower-right strut coupled together.
Figure 9A:
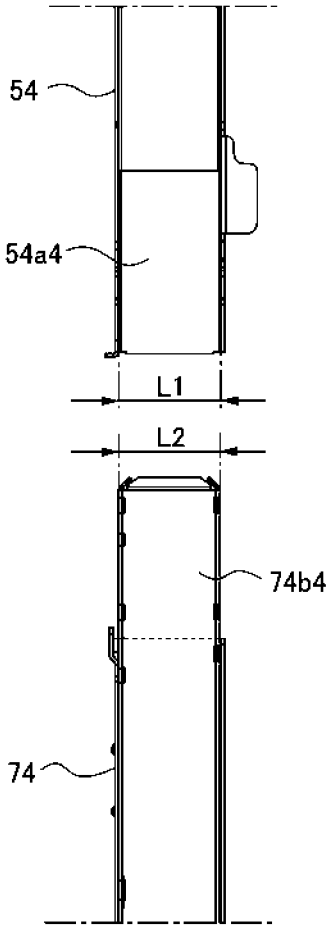
FIG. 9A is a plan view of the upper-right strut and the lower-right strut before coupling.
Figure 9B:
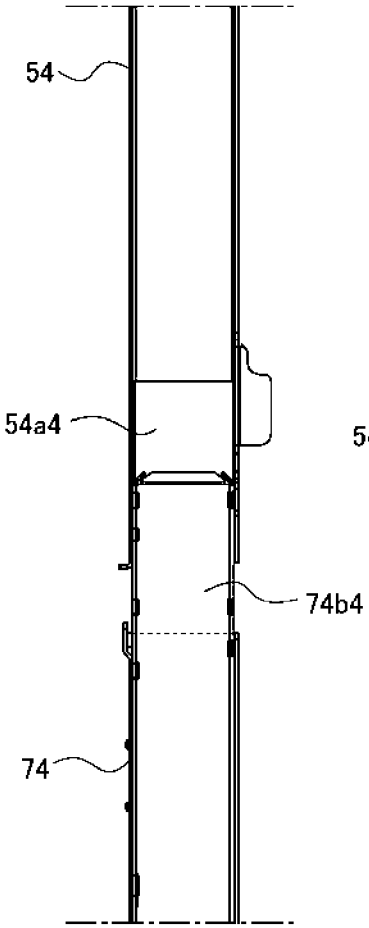
FIG. 9B is a plan view of the upper-right strut and the lower-right strut, which are being coupled together.
Figure 9C:
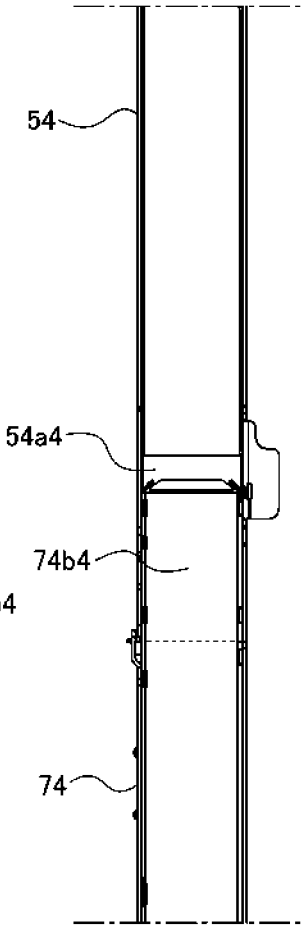
FIG. 9C is a plan view of the upper-right strut and the lower-right strut coupled together.
Figure 9C:
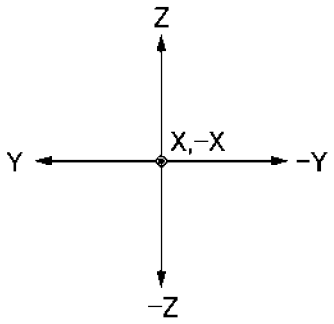

FIGS. 8A, 8B, and 8C are each a perspective view of the upper-right strut 54 and the lower-right strut 74. A process of coupling of the upper-right strut 54 and the lower-right strut 74 is illustrated in the order of FIGS. 8A, 8B, and 8C. FIGS. 9A, 9B, and 9C each illustrate the upper-right strut 54 and the lower-right strut 74 viewed in the direction of arrow −X. A process of coupling of the upper-right strut 54 and the lower-right strut 74 is illustrated in the order of FIGS. 9A, 9B, and 9C.

As illustrated in FIGS. 8A, 8B, 9A, and 9B, at the time of coupling of the upper-right strut 54 and the lower-right strut 74, first, a worker moves the upper-right strut 54 downward in the vertical direction, to insert the protruding portion 74*b*4 of the lower-right strut 74 into the reception portion 54*a*4 of the upper-right strut 54. At this time, with the bent portions 54*a*2 and 54*a*3 of the upper-right strut 54 in contact with the bent portions 74*b*2 and 74*b*3 of the lower-right strut 74, the upper-right strut 54 is guided to move in the vertical direction. The interval L1 between the inner face of the bent portion 54*a*2 and the inner face of the bent portion 54*a*3 of the upper-right strut 54 is wider by 0.5 mm than the interval L2 between the outer face of the bent portion 74*b*2 and the outer face of the bent portion 74*b*3 of the lower-right strut 74. Therefore, when the protruding portion 74*b*4 of the lower-right strut 74 is inserted into the reception portion 54*a*4 of the upper-right strut 54, the position in the direction of arrow Y of the upper-right strut 54 to the lower-right strut 74 is determined with a play of 0.5 mm.

Next, as illustrated in FIGS. 8C and 9C, the worker further moves the upper-right strut 54 downward in the vertical direction. Thus, a butt portion 54*a*1*a* which is the lower end portion of the base portion 54*a*1 of the upper-right strut 54 butts on a butt portion 74*a*1*a* which is the upper end portion of the base portion 74*a*1 of the lower-right strut 74, so that the position in the vertical direction of the upper-right strut 54 to the lower-right strut 74 is determined. The protrusion 54*a*2*a* at the bent portion 54*a*2 of the upper-right strut 54 fits to (engages with) the recessed portion 74*a*2*a* at the bent portion 74*a*2 of the lower-right strut 74. Thus, the position in the direction of arrow X of the upper-right strut 54 to the lower-right strut 74, namely, the movement in the direction orthogonal (crossing) to the vertical direction is regulated, so that the position in the direction orthogonal (crossing) to the vertical direction is determined.

As a result of such positioning between the upper-right strut 54 and the lower-right strut 74, the base portion 74*a*1 of the outer member 74*a* of the lower-right strut 74 is disposed adjacently to the base portion 54*a*1 of the outer member 54*a* of the upper-right strut 54 in the vertical direction. The upper end portion of the base portion 74*a*1 of the outer member 74*a* has contact with the lower end portion of the base portion 54*a*1 of the outer member 54*a*. The bent portion 74*a*2 of the outer member 74*a* of the lower-right strut 74 is disposed adjacently to the bent portion 54*a*2 of the outer member 54*a* of the upper-right strut 54 in the vertical direction. The bent portion 74*a*3 of the outer member 74*a* of the lower-right strut 74 is disposed adjacently to a bent portion 54*a*3 of the outer member 54*a* of the upper-right strut 54 in the vertical direction.

Next, the worker inserts screws, not illustrated, into the screw holes 54*a*2*b* at the bent portion 54*a*2 of the outer member 54*a* of the upper-right strut 54 and the screw holes 74*b*2*a* at the bent portion 74*b*2 of the inner member 74*b* of the lower-right strut 74, resulting in fastening. The worker inserts screws, not illustrated, into the screw holes 54*a*3*a* at the bent portion 54*a*3 of the outer member 54*a* of the upper-right strut 54 and the screw holes 74*b*3*a* at the bent portion 74*b*3 of the inner member 74*b* of the lower-right strut 74, resulting in fastening. Thus, the upper-right strut 54 and the lower-right strut 74 are coupled together. Thus, the position in the direction of arrow Y of the upper-right strut 54 to the lower-right strut 74, namely, the position in the direction orthogonal to the vertical direction is determined. As described above, due to the fitting between the protrusion 54*a*2*a* of the upper-right strut 54 and the recessed portion 74*a*2*a* of the lower-right strut 74 and the screw fastening between the upper-right strut 54 and the lower-right strut 74, the upper-right strut 54 and the lower-right strut 74 are secured with determination in omnidirectional position in the direction orthogonal to the vertical direction. That is, in the present embodiment, the inner member 74*b* of the lower-right strut 74 is part of the lower-right strut 74 and serves as a coupling member which couples the upper-right strut 54 and the lower-right strut 74. Note that the inner member 74*b* of the lower-right strut 74 and the outer member 54*a* of the upper-right strut 54 may be coupled by welding.

As above, in the present embodiment, positioning between the upper-right strut 54 and the lower-right strut 74 is performed directly by both struts. Therefore, in comparison to a configuration in which positioning is performed by members attached to the upper-right strut 54 and the lower-right strut 74, the influence of tolerance is lower, so that the relative positional accuracy between the upper-right strut 54 and the lower-right strut 74 can be inhibited from deteriorating. Thus, at the time of feed of a sheet S from the conveying roller 14*a* to the conveying roller 14*d*, the sheet S is inhibited from skewing, so that the image position to the sheet S can be inhibited from deviating.

<Grips>

Next, the configuration of the grips 86*a* to 86*d* which are grasped at the time of lifting of the image forming apparatus A, will be described. As described above, the grips 86*a* to 86*d* are provided at the lower-right strut 74, the lower-left strut 75, and both end portions in the directions of arrows X and −X of the rear plate 72, respectively. The four grips 86*a* to 86*d* are similar in configuration, and thus the grip 86*a* provided at the lower-right strut 74 will be described exemplarily herein.

Figure 10A:
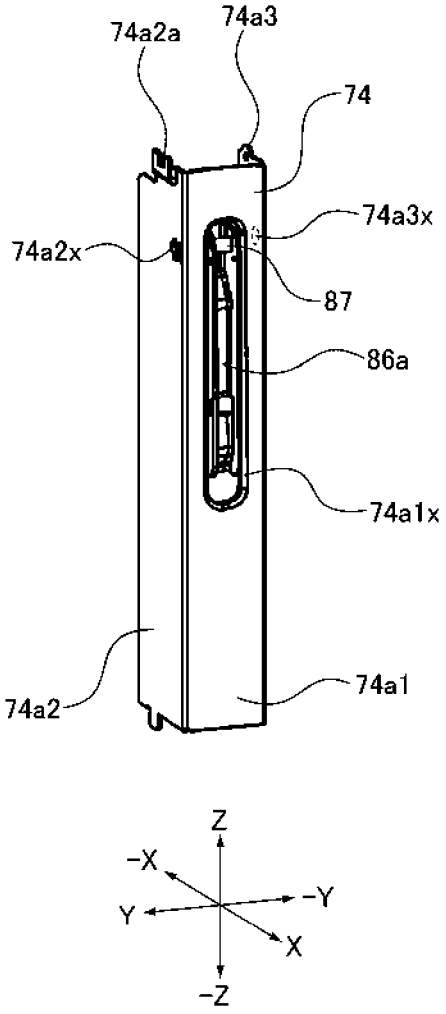
FIG. 10A is an enlarged perspective view of a grip housed in the lower-right strut.
Figure 10B:
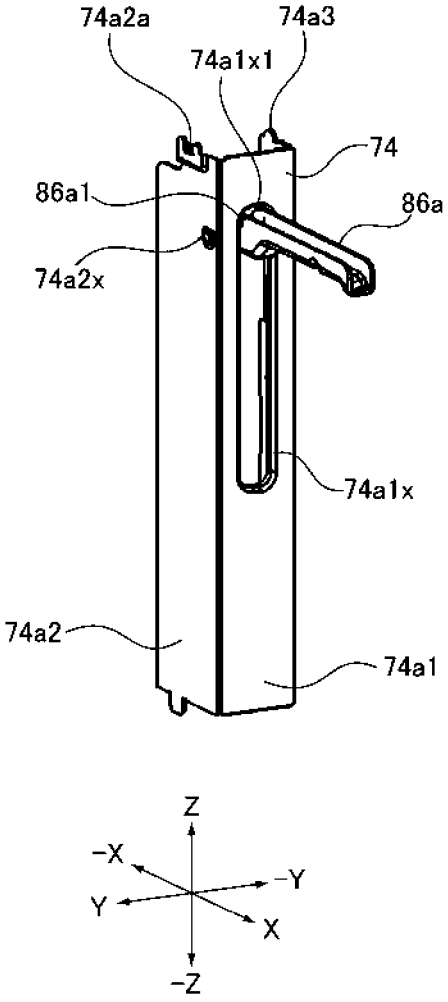
FIG. 10B is an enlarged perspective view of the grip projecting from the lower-right strut.

FIGS. 10A and 10B are each an enlarged perspective view of the grip 86*a* provided at the lower-right strut 74. FIG. 10A illustrates the grip 86*a* housed in the lower-right strut 74. FIG. 10B illustrates the grip 86*a* projecting from the lower-right strut 74. Note that the inner member 74*b* of the lower-right strut 74 is omitted in FIGS. 10A and 10B.

As illustrated in FIGS. 10A and 10B, the base portion 74*a*1 of the outer member 74*a* of the lower-right strut 74 has, due to drawing, a through hole 74*a*1*x* passing in the direction of thickness of the base portion 74*a*1 (direction of arrow X). The bent portion 74*a*2 of the outer member 74*a* of the lower-right strut 74 has, due to drawing, a through hole 74*a*2*x* passing in the direction of thickness of the bent portion 74*a*2 (direction of arrow Y). The bent portion 74*a*3 of the outer member 74*a* of the lower-right strut 74 has, due to drawing, a through hole 74*a*3*x* passing in the direction of thickness of the bent portion 74*a*3 (direction of arrow Y).

The grip 86*a* has a through hole, not illustrated, passing in the direction of arrow Y. A shaft 87 inhibited from coming off is inserted in the through hole, not illustrated, of the grip 86*a* and the through holes 74*a*2*x* and 74*a*3*x* of the lower-right strut 74. Thus, the grip 86*a* is supported pivotably around the shaft 87 as a pivot to the lower-right strut 74. That is, in the free state, the grip 86*a* has the center of pivoting above a portion that a user grasps, in the vertical direction. The grip 86*a* pivots between the position at which the grip 86*a* is housed in the through hole 74*a*1*x* of the lower-right strut 74 (first position) and the position at which the grip 86*a* projecting from the through hole 74*a*1*x* is graspable by the user (second position). As illustrated in FIG. 10A, at the first position, the grip 86*a* is supported by the shaft 87 such that the direction in which the lower-right strut 74 extends and the direction in which the grip 86*a* extends are identical. Note that, in the present embodiment, as the state where the grip 86*a* is housed in the lower-right strut 74, at least part of the grip 86*a* requires locating inside the through hole 74*a*1*x* of the lower-right strut 74, and thus the entirety of the grip 86*a* may be located inside the through hole 74*a*1*x*.

For use of the grip 86*a*, a worker pivots the grip 86*a*, so that the grip 86*a* projects from inside the through hole 74*a*1*x* of the lower-right strut 74. When an abutting portion 86*a*1 near the proximal portion of the grip 86*a* abuts on an abutting portion 74*a*1*x*1 which is the upper end portion of the inner wall of the through hole 74*a*1*x*, the pivoting is regulated, so that the projecting grip 86*a* stops. As illustrated in FIG. 10B, at the second position, the pivoting of the grip 86*a* is regulated by the abutting portion 74*a*1*x*1 such that the direction in which the lower-right strut 74 extends and the direction in which the grip 86*a* extends are substantially perpendicular to each other. That is, the angle of the grip 86*a* to the lower-right strut 74 at the second position is larger than an angle at the first position.

The worker grasps the grip 86*a* projecting and having been regulated in pivoting, to lift the image forming apparatus A. In this way, the grip 86*a* is used. When the worker releases the hand from the grip 86*a* after lowering the image forming apparatus A, the grip 86*a* pivots, due to its own weight, to the inside of the through hole 74*a*1*x* of the lower-right strut 74, so that the grip 86*a* is housed in the lower-right strut 74. That is, in the free state, the grip 86*a* is located at the position at which the grip 86*a* is housed in the lower-right strut 74.

As above, in the present embodiment, in the image forming apparatus A with the frame 100 including the upper frame 50 and the lower frame 70 coupled together, the lower frame 70 is provided with the grips 86*a* to 86*d*. With such a configuration, at the time of lifting of the image forming apparatus A with the grips 86*a* to 86*d* grasped, most of the weight of the lower frame 70 is received by the abutting portions between the lower frame 70 and the grips 86*a* to 86*d*. Therefore, the coupling portion between the upper frame 50 and the lower frame 70 is inhibited from being affected by the weight of the lower frame 70, so that the coupling portion can be inhibited from deforming.

Figure 11:
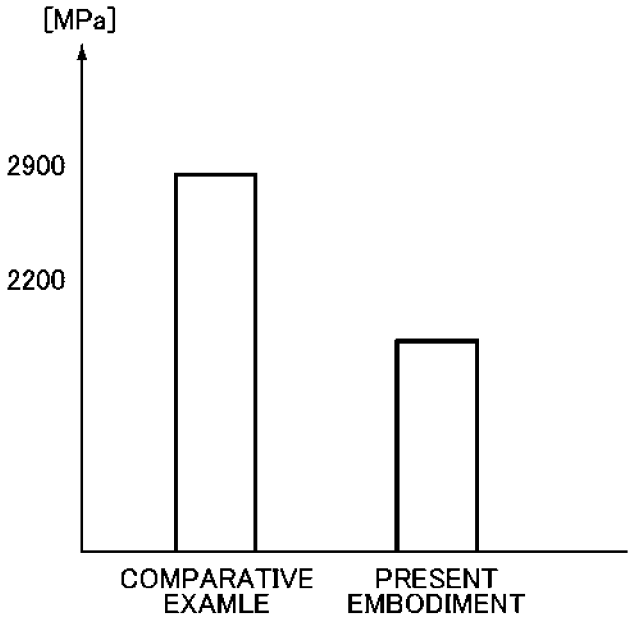
FIG. 11 is a graph of comparative experimental results of stress affecting the coupling portion between the upper frame and the lower frame.

FIG. 11 is a graph of comparative experimental results of stress affecting the coupling portion between the upper frame 50 and the lower frame 70 at the time of lifting of the image forming apparatus A, between the configuration according to the present embodiment and a configuration according to a comparative example. In the configuration according to the comparative example, both end portions in the directions of arrows X and −X of the rear plate 52, the upper-right strut 54, and the upper-left strut 55 in the upper frame 50 are each provided with a grip.

As illustrated in FIG. 11, the configuration according to the present embodiment is lower than the configuration according to the comparative example by 43% in stress affecting the coupling portion between the upper frame 50 and the lower frame 70. As above, from the experimental results, it has been verified that the configuration according to the present embodiment inhibits the coupling portion between the upper frame 50 and the lower frame 70 from deforming.

Note that, in the present embodiment, given has been the configuration in which the image forming unit 10, the sheet cassettes 11*a* to 11*c*, and the conveying rollers 14*a* and 14*d* are positioned by the front plate 53 of the upper frame 50 and the front plate 73 of the lower frame 70. However, the present invention is not limited to this. That is the members may be positioned by the rear plate 52 of the upper frame 50 and the rear plate 72 of the lower frame 70.

In the present embodiment, the through hole 74*a*1*x* of the lower-right strut 74 serves as a housing portion in which the grip 86*a* is housed. However, the present invention is not limited to this. Thus, a space in which at least the grip 86*a* is housed requires providing. That is, as a hole portion in which the grip 86*a* is housed, provided may be a through hole or a recessed portion having a bottom face.

In the present embodiment, the image forming apparatus A is assumed to be conveyed at a stage before attachment of an exterior cover. That is, assumed is conveyance with the frame 100 exposed. In a case where the image forming apparatus A is assumed to be conveyed after attachment of the exterior cover, portions of the exterior cover corresponding to the grips 86*a* to 86*d* disposed may have holes for exposure of the grips 86*a* to 86*d* from the exterior cover.

Figure 12:
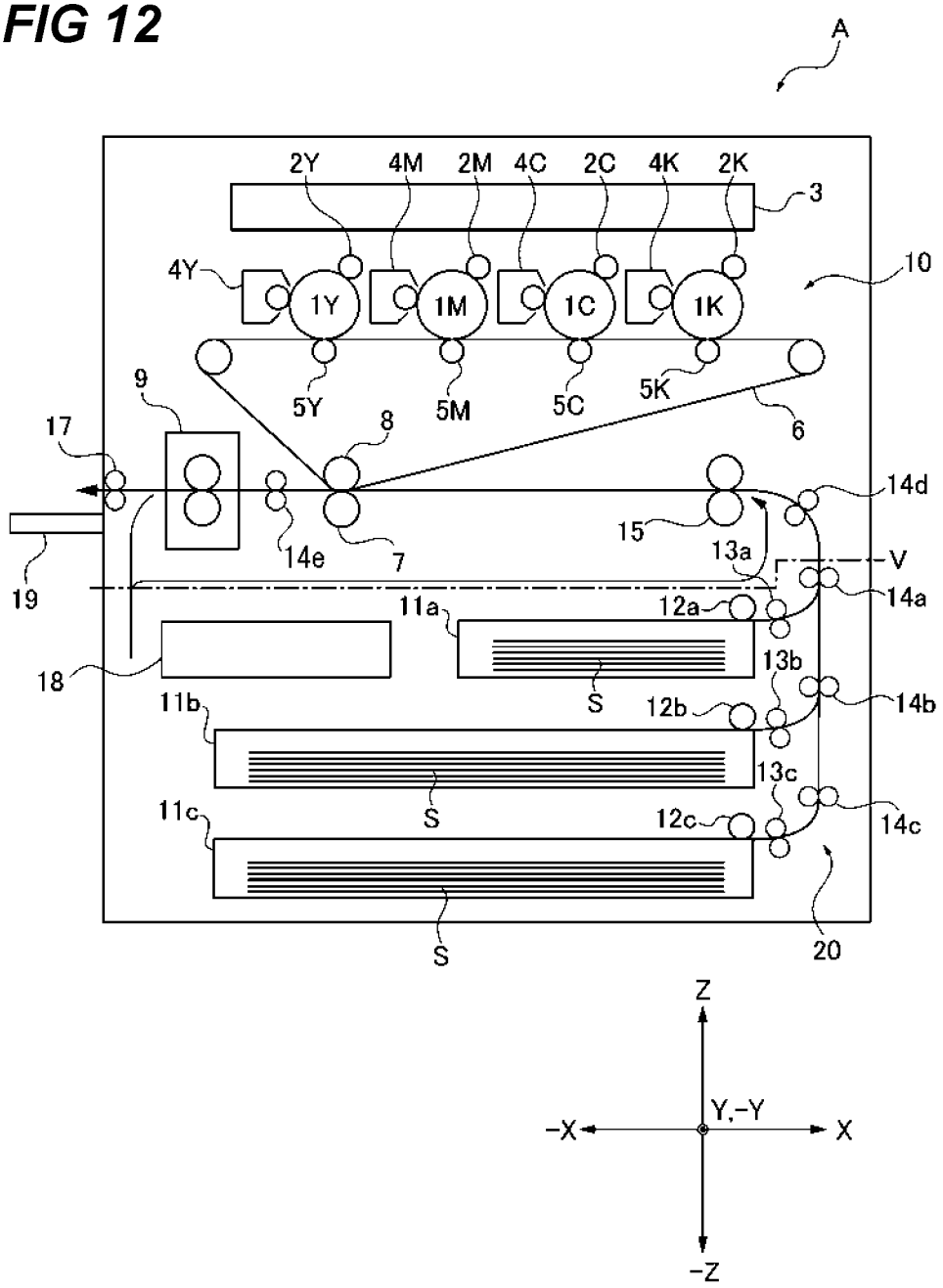
FIG. 12 is a schematic sectional view of an image forming apparatus.

The arrangement of each member supported by the upper frame 50 or the lower frame 70 can be changed appropriately. For example, as illustrated in FIG. 12, the sheet cassette 11*a*, which is supported by the lower frame 70, may be miniaturized to house small-sized sheets S. In addition, the toner collection container 18 may be disposed at a space resulting from the miniaturization.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-086347, filed May 15, 2020 which is hereby incorporated by reference herein in its entirety.

What is claimed is:

1. An image forming apparatus comprising:

a sheet cassette configured to accommodate a sheet;

an image forming unit configured to form an image on the sheet fed from the sheet cassette;

a first frame including: a first strut; a side plate spaced apart from the first strut; and a stay coupling the first strut and the side plate, the first frame supporting the sheet cassette, the sheet cassette being slidable in a direction in which the stay extends;

a second frame provided on the first frame in a vertical direction, the second frame including a second strut coupled to the first strut, the second frame supporting the image forming unit, the second frame being supported by the first frame; and a grip provided pivotably at the first strut, the grip being graspable by an operator.

2. The image forming apparatus according to claim 1, wherein the grip has a pivot at an upper portion of the grip in the vertical direction, the pivot being rotatably provided to the first strut, and the grip pivots between a first position at which the grip is supported in a free state to the first strut and a second position at which an angle of the grip to the first strut is larger than that of the first position.

3. The image forming apparatus according to claim 2, wherein the grip in the free state is located at the first position.

4. The image forming apparatus according to claim 2, wherein the first strut is provided with a hole portion in which the grip located at the first position is accommodated, and in pivoting of the grip, the grip abuts on an inner wall of the hole portion such that the pivoting of the grip is regulated at the second position.

5. The image forming apparatus according to claim 1, wherein the first frame includes:

a third strut spaced apart from the first strut and the side plate;

a first guide portion coupling the first strut and the side plate, the first guide portion supporting the sheet cassette for slidable movement; and a second guide portion coupling the third strut and the side plate, the second guide portion supporting the sheet cassette for slidable movement together with the first guide portion, and the sheet cassette being slidable between the first strut and the third strut.

6. The image forming apparatus according to claim 5, wherein the third strut is provided with another grip.

7. The image forming apparatus according to claim 6, wherein the other grip is supported pivotably to the third strut, and the other grip pivots between a third position at which the other grip is accommodated in the third strut and a fourth position at which the other grip projects from the third strut.

8. The image forming apparatus according to claim 7, wherein the other grip in a free state is located at the third position.

9. The image forming apparatus according to claim 7, wherein the third strut has another hole portion in which the other grip is accommodated, and in pivoting of the other grip from the third position to the fourth position, the other grip abuts on an inner wall of the other hole portion such that the pivoting of the other grip is regulated.

10. The image forming apparatus according to claim 6, wherein other grips which are different from the grip and the other grip, are provided at both end portions of the side plate in a direction orthogonal to a direction of movement of the sheet cassette and the vertical direction.

11. The image forming apparatus according to claim 5, wherein the first frame includes a bottom plate, and the first strut, the third strut, and the side plate are fixed to the bottom plate.

12. An image forming apparatus comprising:

a sheet cassette configured to accommodate a sheet;

an image forming unit configured to form an image on the sheet fed from the sheet cassette;

a conveying roller configured to convey a sheet stored in the sheet cassette;

a registration roller configured to correct skew feeding of the sheet conveyed by the conveying roller;

a first frame supporting the sheet cassette and the conveying roller, the first frame including: a first strut; a side plate spaced apart from the first strut; and a stay coupling the first strut and the side plate;

a second frame provided on the first frame in a vertical direction, the second frame including a second strut coupled to the first strut, the second frame being supported by the first frame, the second frame supporting the image forming unit and the registration roller; and a grip disposed on the first strut, the grip being configured to move between a first position where the grip is accommodated in the first strut and a second position where the grip is gripped by a user.

13. The image forming apparatus according to claim 12, further comprising another conveying roller;

wherein the other conveying roller is supported by the first frame at upstream side of the registration roller in a sheet conveying direction.

14. The image forming apparatus according to claim 12, wherein the first strut comprises a first metal plate having a recess to accommodate the grip and a second metal plate projecting toward the first metal plate in a vertical direction, and wherein the second strut has a third metal plate secured on the second metal plate, wherein a cross section configured by the first metal plate and the second metal plate has a substantially square shape and a cross section configured by the second metal plate and the third metal plate has a substantially square shape.

15. The image forming apparatus according to claim 12, wherein the first strut comprises a metal plate having a recess in which the grip is accommodated and wherein the second strut comprises another metal plate disposed at a position higher than the first metal plate, wherein the image forming apparatus further comprises a connecting metal plate which is secured with and connects the metal plate of the first strut and the metal plate of the second strut together.

16. The image forming apparatus according to claim 12, further comprising another grip, the other grip being configured to move between a fifth position where the grip is accommodated in the side plate and a sixth position where the grip can be held by the user.

17. The image forming apparatus according to claim 12, wherein the grip is pivotably provided to the first strut.

18. The image forming apparatus according to claim 12, wherein the grip in the free state is located at the first position.

19. The image forming apparatus according to claim 12, wherein the first frame includes:

a third strut spaced apart from the first strut and the side plate;

a first guide portion coupling the first strut and the side plate, the first guide portion supporting the sheet cassette for slidable movement; and a second guide portion coupling the third strut and the side plate, the second guide portion supporting the sheet cassette for slidable movement together with the first guide portion, and the sheet cassette being slidable between the first strut and the third strut.

* * * * *